United States Patent [19]

Bower, Jr. et al.

[11] 4,339,006

[45] Jul. 13, 1982

[54] METHOD AND APPARATUS FOR MINE ROOF DRILLING

[75] Inventors: Arnold B. Bower, Jr.; Randall W. Ojanen, both of Bristol, Va.

[73] Assignee: General Electric Company, Detroit, Mich.

[21] Appl. No.: 259,500

[22] Filed: May 1, 1981

Related U.S. Application Data

[63] Continuation of Ser. No. 100,214, Dec. 4, 1979, abandoned.

[51] Int. Cl.[3] ..... E21C 1/00; E21B 17/04

[52] U.S. Cl. ..... 175/57; 175/320

[58] Field of Search ..... 175/52, 57, 219, 320; 173/34, 36, 38; 405/259

[56] References Cited

U.S. PATENT DOCUMENTS

| | | | |
|---|---|---|---|
| 1,760,316 | 5/1930 | Osgood | 173/36 X |
| 2,407,976 | 9/1946 | Curtis et al. | 175/320 X |
| 3,902,561 | 9/1975 | Friberg et al. | 175/52 |
| 4,019,590 | 4/1977 | Hansen et al. | 175/57 |
| 4,177,894 | 10/1978 | Saunders | 173/38 |

*Primary Examiner*—Ernest R. Purser

*Attorney, Agent, or Firm*—Hedman, Casella, Gibson & Costigan

[57] ABSTRACT

A method and apparatus for drilling bolt holes in a mine roof is described. The drill head of a roof bolting drill is provided with a deep chuck adapted to receive the lower male end of a conventional drill steel driver. In a drilling operation, a drill bit is connected to the upper female end of a drill steel driver, with the lower male end of the driver being connected to the deep chuck of the roof bolting drill. The drill bit is rotated and raised enabling it to bore a hole into the mine roof. Drilling continues until the drill steel driver is at least partially disposed within the bolt hole whereupon the driver is disconnected from the deep chuck. The drill is then lowered so that the lower male end of a second identical drill steel driver may be connected to the deep chuck, while the upper female end of the second drill steel driver is connected to the lower male end of the first drill steel driver enabling the drilling to continue. By adding additional drill steel drivers in this manner, a hole may be drilled to the desired depth.

14 Claims, 6 Drawing Figures

METHOD AND APPARATUS FOR MINE ROOF DRILLING

This is a continuation of application Ser. No. 100,214 filed Dec. 4, 1979 now abandoned.

This invention relates to an apparatus and a method for mine roof drilling. More particularly, a system is disclosed wherein a roof bolting drill is provided with a deep chuck connected to the drill head thereof. A plurality of identical drill steel drivers are provided having a lower male end and an upper female end. In a drilling operation, a drill bit is connected to a drill steel driver which is in turn connected to the drill head. The bolt hole is drilled by rotating the drill bit and raising the drill head until the drill steel driver is at least partially disposed within the drill hole. The drill steel driver is then disconnected from the deep chuck, and the driver head is lowered so that a second drill steel driver may be inserted and connected to both the deep chuck and the first drill steel driver, thereby enabling the drilling to continue. Additional drill steel drivers may be added until a hole is drilled to the desired depth.

BACKGROUND OF THE INVENTION

In mining operations, it is necessary as a safety precaution to stabilize or shore up mine roofs to reduce the likelihood of their collapse. To this end, roof plates or boards are bolted to the mine roof to prevent pieces of rock from falling down and injuring miners or sealing off passageways. In the process of installing a roof bolt plate, a bolt hole is drilled in the mine roof and a generally rectangular plate or board is affixed to the roof by a mechanical bolt or a bolt grouted in place by means of a resin bolting system.

A number of roof bolting drills are found in the prior art for drilling bolt holes in preparation for installing a roof bolting plate. The roof bolting drill is provided with a drill head which is movable mechanically in a vertical direction. Attached to the drill head is a chuck having a relatively shallow female end which is rotated at high speed by the drill head. Lengths of hollow tubular drill steel drivers are usually connected to the chuck during a drilling operation. In the prior art, a number of different drill steel drivers are employed during a single drilling operation. More specifically, to drill a bolt hole to a depth of six feet, a drill steel starter having a relatively short lower male end is mounted onto the female end of the chuck, and an oversized bit is connected to the upper female end of the starter drill steel. The drill head rotates the starter and bit thereby initiating the drilling operation. The drill head is mechanically raised until the hole is drilled to a depth equal to the length of the drill steel starter driver. The drill head is then lowered such that the drill steel starter and the oversized drill bit may be entirely removed from the hole, enabling the starter and bit to be disconnected from the chuck. A lead extension driver having a relatively deep female end, which is connected to a second drill bit having a smaller diameter, is then inserted into the partially drilled bolt hole. The second bit must be of a lesser diameter than the first bit to facilitate the insertion of the bit into the hole. A second lower drill steel driver having a relatively short male lower end is then inserted into the chuck and its relatively deep upper female end is connected to the lead extension. Drilling is resumed with the drive head raising the lower driver and lead extension up into the bolt hole. Should the combination of the lead extension and the lower drill steel driver fail to drill a hole to the desired depth, the lower driver is disconnected from the lead extension and lowered such that a middle extension driver can be installed between the lower driver and the lead extension. A conventional middle extension driver is provided with a relatively long lower male end and a relatively deep upper female end. By repeated additions of middle extension drivers, drilling may continue until a hole is drilled to the desired depth.

Thus, each time a bolt hole was drilled in a mine roof using known systems, two different drill bits were required in addition to the use of a variety of drivers such as the starter, lead extension, lower driver and middle extension. Further, the chuck employed in the prior art has a fairly shallow female upper end which results in potentially dangerous procedures. More specifically, when the drill steel drivers are retracted from the bolt hole, they are generally rotated to facilitate withdrawal. Frequently, the bit or a portion fo the drill steel will become jammed in the bolt hole causing the unwanted and sudden separation of the drill steel from the chuck such that the free end of the drill steel creates a hazard to the operator. Further, if the drill steel accidentally breaks, the portion of the drill steel which remained in the chuck tends to fly out, which can also result in injury to the operator.

Therefore, it is an object of the subject invention to provide an apparatus and a method for drilling a bolt hole in a mine roof wherein the drill steel drivers utilized in the drilling operation are substantially identical.

It is another object of the subject invention to provide an apparatus and a method for drilling bolt holes in a mine roof wherein only one size drill bit need be used in each drilling operation.

It is a further object of the subject invention to provide an apparatus and a method for drilling holes in a mine roof wherein the roof bolting drill is provided with a chuck having a female drive of extended depth thereby providing uniform, straight drill holes, and improved safety for the operator.

It is still another object of the subject invention to provide a method and apparatus for drilling a hole in a mine roof which is faster and more economical then heretofore.

DESCRIPTION OF THE INVENTION

Figure 1:
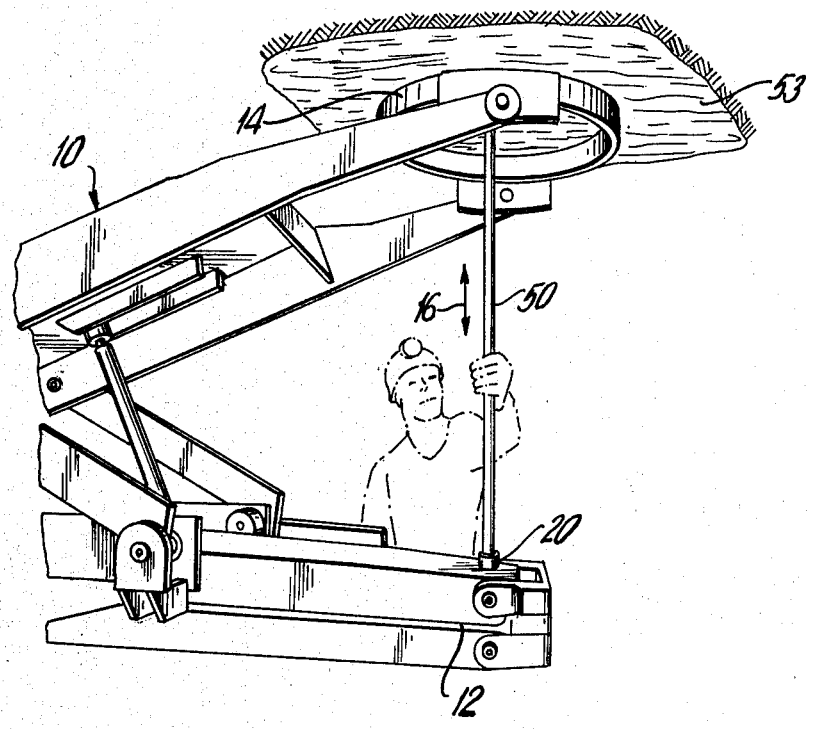
FIG. 1 is a perspective view of a roof bolting drill illustrating a step in a roof drilling method of the subject invention.

According to the present invention there is provided a method and an apparatus for drilling bolt holes in a mine roof in preparation for mine roof bolting. More particularly, a new and improved deep chuck is provided which is used in conjunction with a conventional roof bolting drill such that a new and improved method for drilling holes may be utilized.

A roof bolting drill is provided with a drill head which functions to rotate a chuck at high speeds. In addition, the drill head can be mechanically raised or lowered during a drilling operation. The drill chucks of the prior art were provided with a fairly shallow upper female end which was adapted to receive the relatively short lower male end of either a drill steel starter or a lower drill steel driver which are common in the industry. In accordance with the subject invention a new and improved deep chuck is provided wherein the upper female end is adapted to receive the longer, lower male end of a middle extension drill steel driver also commonly found in the industry. By employing a deep chuck, all the various types of tool steels used in the prior art, except for the middle extension drill steel driver, may be eliminated from a drilling operation. In addition, since the need for a drill steel starter is obviated, the first bit used in the system of the subject invention may remain in the hole and thus the need for a second bit is also eliminated. Further, the inherent additional stability associated with using a deep chuck, which is adapted to receive a relatively long lower male end of a middle extension driver produces a variety of advantages. More specifically, the deep chuck functions to align the middle extension driver in a vertical position due to the fact that a firmer, more rigid support for the middle extension is available. Secondly, should the drill steel driver accidentially break during a drilling operation, the lower end of the drill steel driver tends to remain mounted within the deep chuck rather than flying away from the drill head of the roof bolting machine and creating a dangerous condition. In addition, when the hole has been drilled to the desired depth, the drill steel driver and the drill bit are retracted from the hole while being rotated. Frequently, the drill steel driver and bit will become hung up in the hole which can cause the drill steel driver to spring loose from the chuck. By providing a deep chuck, the middle extension driver tends to remain held within the chuck thereby preventing injury to the operator.

By utilizing the new and improved deep chuck of the subject invention in conjunction with a plurality of identical middle extension drill steel drivers, a faster, safer and more economical method of drilling bolt holes is achieved. More particularly, in the drilling operation of the subject invention, a plurality of identical middle extension drill steel drivers (hereinafter called drivers) are provided having elongated lower male ends and deep upper female ends. The shank of a conventional drill bit is connected to the upper female end of the drill steel driver, and the lower male end is mounted within the new and improved deep chuck of the subject invention. The drilling operation commences when the drill head causes the rotation of the deep chuck, the driver and the drill bit such that the drill bit begins to bore into the mine roof. The drill head is mechanically raised allowing the drill bit to bore further into the mine roof. At a point where the driver is at least partially disposed within the mine roof the drilling is halted such that the deep chuck may be disconnected from the driver and lowered. At this point, another identical drill steel driver is mounted within the deep chuck and its upper end is connected to the lower male end of the first driver. Rotation of the drill head and chuck then resumes enabling the further drilling of the hole. Drilling may continue by adding drivers in this manner, until a hole of the desired depth is obtained. By this arrangement, the need for a variety of drivers, as well as additional drill bits is eliminated. More particularly, the starter, lead extension, and lower driver common in the industry need not be used. Further, since the driver and the drill bit used at the initiation of the drilling operation remain in the hole until the drilling is complete, the need for an initial oversize bit coupled with a tool steel starter is unnecessary. In addition, the step of removing the oversize bit and the starter is eliminated. Thus, besides reducing the inventory of parts necessary for the driling a bolt hole, the method of the subject invention provides a faster and safer way of drilling bolt holes.

DESCRIPTION OF THE PREFERRED EMBODIMENT

Figure 2:
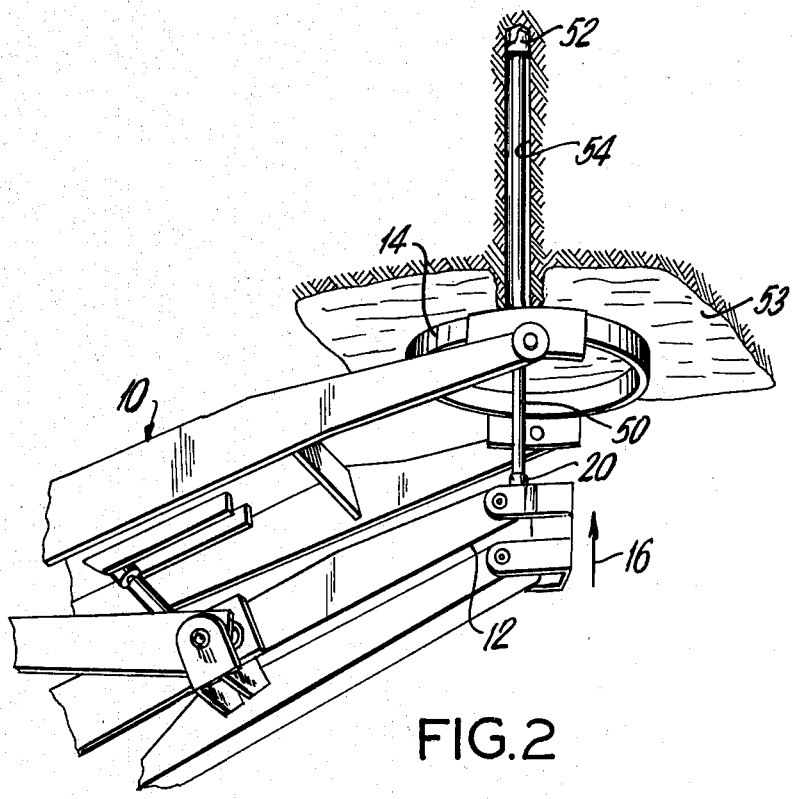
FIGS. 2 and 3 are perspective views of a roof bolting drill illustrating subsequent steps in the method for drilling a bolt hole according to the subject invention.
Figure 3:
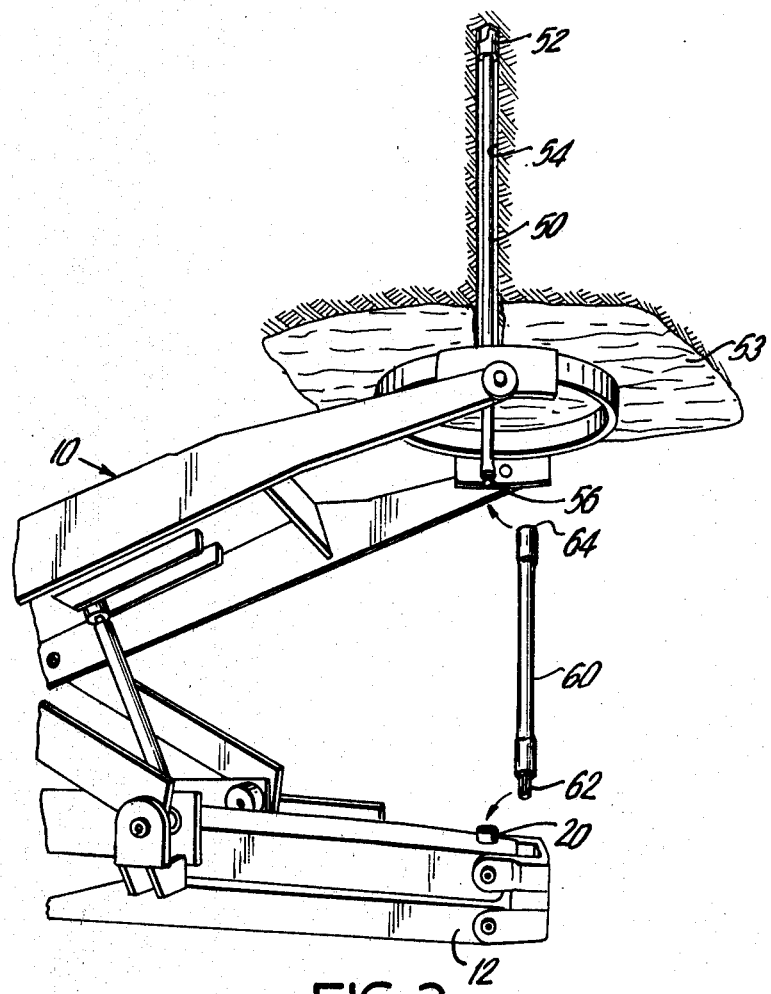

As illustrated in FIGS. 1 through 3, a portion of a conventional roof bolting drill is indicated generally by the numeral 10, and includes a drill head 12 and a protective canopy 14. The drill head 12 may be mechanically raised or lowered in the vertical direction as designated by arrows 16. The drill head 12 is connected to a means (not shown) for imparting a high speed rotational drive to the chuck 20.

Figure 4:
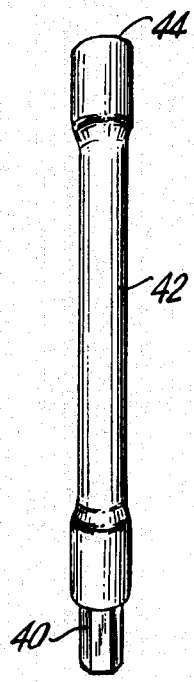
FIG. 4 is a perspective view of a drill steel driver.
Figure 5:
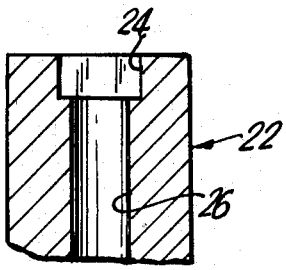
(PRIOR ART) FIG. 5
FIG. 5 is a cross sectional view of a chuck of the prior art.
Figure 6:
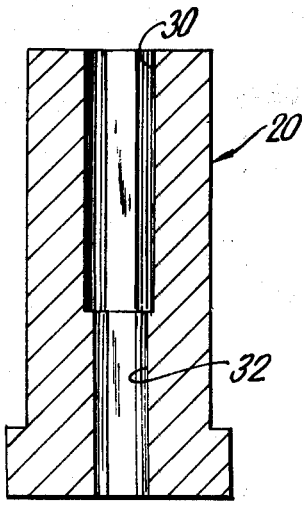
FIG. 6 is a cross sectional view of the deep chuck of the subject invention.

Deep chuck 20 is more particularly illustrated in FIG. 6, whereas FIG. 5 illustrates a chuck 22 according to the prior art. The prior art chuck 22 is formed having a rather shallow female opening 24 in its upper end which is in communication with an axial bore 26 which functions as a chip removal port when the drilling operation is vacuum assisted. In contrast, the new and improved deep chuck 20 of the subject invention provides for a substantially deeper female section 30 which is adapted to receive the lower male section 40 of a conventional middle extension driver 42 as illustrated in FIG. 4. Deep chuck 20 is further provided with an axial bore 32 for chip removal in a vacuum drilling process. In a preferred embodiment, the deep chuck 20 is designed for use in conjunction with a conventional $\frac{7}{8}$ inch driver 42.

The upper female section 30 of deep chuck 20 is preferably hexagonally shaped and is adapted to receive the lower male end 40 of driver 42. While a hexagonal shape coupled with a particular diameter is illustrated, any combination of the size and shape of the deep chuck and the lower male end of the driver is intended to be covered within the scope of the subject invention. The driver 42, as more particularly illustrated in FIG. 4, is provided with a lower male end 40 having a hexagonal configuration and is additionally provided with an upper female end 44 also of hexagonal configuration of similar dimensions. By this arrangement, the upper female end 44 is adapted to receive not only a conventional hexagonal shank drill bit, but in addition can interfit with the lower male end of another middle extension driver. Thus, a plurality of drivers may be mounted one on top of the other in accordance with the new and improved method of drilling of the subject invention. Since a vacuum system is often employed for drawing rock chips away from the drill bit, the drivers are provided with a hollow interior, thereby permitting the chips to be drawn through the drivers to a collecting point on the roof bolting drill.

In a drilling operation, according to the teachings of the subject invention, as illustrated in FIGS. 1 through 3, a driver 50 is mounted into deep chuck 20. The latter is connected to drive head 12 of a conventional roof bolting drill. A drill bit 52, as illustrated in FIG. 2, is mounted on driver 50. The drilling operation begins as the drill head 12 is raised along the direction indicated at 16 until the drill bit 52 abuts the mine roof 53. The drill head 12 then functions to rotate the deep chuck 20, driver 50 and drill bit 52 thereby enabling the drill bit 24 to begin boring into the mine roof 53. During the drilling operation, the drill head 12 is mechanically raised such that the bit may progressively drill a deeper bolt hole 54. When the driver 50 is at least partially disposed within the bolt hole 54 drilling is halted and the driver 50 is disconnected from the deep chuck 20. The drill head 12 is then lowered to an extent sufficient to enable a second driver 60 to be inserted between the deep chuck 20 and the lower male end 56 of the first driver 50. The lower male end 62 of the second driver 60 is then mounted in the deep chuck 20, while the upper female end 64 of the driver 60 is connected to the lower male end 56 of the first driver 50. The drill head 12 then functions to rotate the deep chuck 20 at high speed thereby resuming the drilling operation. The drill head 12 is raised until the second driver 60 is at least partially disposed within the bolt hole 54. Should the two drivers 50, 60 fail to drill a bolt hole to the required depth, additional drivers of identical construction may be added in the same manner as the second driver 60. Drilling continues by adding additional drivers until a bolt hole of the desired depth is obtained. If it is desirable to accompany the drilling operation with a liquid flow for cooling and back flushing particles, a rubber or plastic sealing ring may be fitted between the driver sections to seal the connections.

When the bolt hole 54 has been drilled to the desired depth, the drill head 12 is lowered such that each tool steel driver may be disconnected and removed. While removing the drill steel drivers from the bolt hole 54, it is desirable to rotate the deep chuck 20 and the drivers to facilitate their removal.

Drilling bolt holes in accordance with the new and improved method of the subject invention is simpler and less time consuming then the methods used in the prior art. More particularly, the prior art required a drill steel starter connected to an oversize bit to drill a pilot hole, which necessitated the entire removal of the starter and oversize bit from the bolt hole before continued drilling could occur. In accordance with the subject invention, the drill bit and the first drill steel driver remain in the hole until drilling is complete thereby reducing the number of steps necessary to drill a bolt hole. Further, since only identical drill steel drivers are used, the conventional inventory of starters, lead extensions and lower drivers may be eliminated thereby substantially reducing the cost involved in bolt hole drilling.

Accordingly, there is provided a new and improved apparatus and method for the drilling of bolt holes in mine roofs. More particularly, a conventional roof bolting drill having a drive head is provided with a new and improved deep chuck which has an upper female end adapted to receive the lower male end of a tool steel middle extension driver. The drill steel driver is provided with an upper female end which is adapted to receive the lower male end of another drill steel driver, as well as the shank of a drill bit. During a drilling operation, a drill steel driver is mounted into the deep chuck of the subject invention and a drill bit is mounted on the upper female end of the drill steel driver. The driver head is then raised until the drill bit abuts the mine roof with the drive head then imparting a high speed rotation to the deep chuck, driver and drill bit enabling the drill bit to bore into the mine roof. The drill head is raised until the driver is at least partially disposed within the bolt hole at which point the deep chuck is disconnected from the lower male end of the drill steel driver and the drive head is lowered. A second drill steel driver of identical construction to the first drill steel driver may then be connected between the deep chuck and the lower end of the first drill steel driver enabling the drilling operation to continue. Additional drill steel drivers may be added in this manner until a hole of the desired depth has been drilled.

It is to be understood that changes may be made in the particular embodiment of the invention in light of the above teachings, but that these will be within the full scope of the invention as defined by the appended claims.

We claim:

1. Apparatus for drilling bolt holes in mine roofs comprising:

a roof bolting drill means having a drill head movable in a vertical direction;

a deep chuck connected to said drill head and having an upper female end;

a drill bit having a lower shank portion; and at least two identical drill steel drivers each having a lower male end and an upper female end and wherein the lower male end of each drill steel driver is capable of engagement with either the upper female end of said deep chuck or the upper female end of another drill steel driver, and wherein the upper female end of each said drill steel driver is capable of engagement with either the lower shank portion of said drill bit or the lower male end of another drill steel driver, and whereby in a drilling operation initially one said drill steel driver is interconnected between said drill bit and said deep chuck, after which, in order to continue said drilling operation another of said drill steel drivers may be interposed between said deep chuck and the lower male end of said one drill steel driver thereby drilling the hole to the desired depth.

2. An apparatus for drilling bolt holes as recited in claim 1 wherein the upper female end of said deep chuck, and the upper and lower ends of said drill steel drivers are generally hexagonal in configuration.

3. An apparatus for drilling bolt holes as recited in claim 1 wherein said deep chuck further includes an axial bore for the collection of particles.

4. An apparatus for drilling bolt holes as recited in claim 1 wherein said drill steel drivers are hollow, such that they may be used in conjunction with a vacuum system.

5. A method of drilling a bolt hole in a mine roof utilizing a roof bolting drill provided with a deep chuck having an upper female end, a drill bit having a lower shank portion, and at least two identical drill steel drivers, said drill steel drivers having an upper female end and a lower male end, wherein the upper female end of the drill steel driver is capable of engagement with either the lower shank portion of the drill bit or the lower male end of another drill steel driver, and wherein the lower male end of each drill steel driver is capable of engagement with either the upper female end of said deep chuck or the upper female end of another drill steel driver, said roof bolting drill being further provided with a drill head connected to said deep chuck, said drill head being movable in the vertical direction and capable of rotating said deep chuck, said method comprising the steps of:

(a) mounting the lower male end of one of said drill steel drivers into the upper female end of said deep chuck;

(b) mounting the shank of the drill bit into the upper female end of said one drill steel driver;

(c) raising said drill head until said drill bit abuts the mine roof;

(d) rotating said deep chuck while simultaneously raising said drill head such that said drill bit bores into said roof creating a bolt hole and continuing said rotating and raising until said one drill steel driver is at least partially disposed within said bolt hole;

(e) disconnecting said one drill steel driver from said deep chuck;

(f) lowering said drill head while said one drill steel driver and said drill bit is maintained in the hole;

(g) mounting the lower male end of another drill steel driver into the female end of said deep chuck;

(h) raising said drill head until the upper female end of said another drill steel driver abuts the bottom male end of said one drill steel driver;

(i) connecting the upper female end of said another drill steel driver to the lower male end of said one drill steel driver;

(j) rotating said deep chuck while simultaneously raising said drill head such that said drill bit bores further into said roof; and (k) lowering said drill head with said drill steel drivers and said drill bit connected thereto from said bolt hole while being rotated.

6. A method of drilling a bolt hole as recited in claim 5 wherein prior to said step (k) of lowering said drill head to remove said drill steel drivers from said hole, additional drill steel drivers are interposed in accordance with steps (g) through (j) until a bolt hole is drilled to the desired depth.

7. A method of drilling bolt holes as in claim 5 further including the step of attaching a sealing ring between said drill steel drivers thereby permitting the use of a liquid coolant to pass through the drill steel drivers.

8. Apparatus for drilling bolt holes in mine roofs comprising:

a roof bolting drill means having a drill head movable in a vertical direction;

a chuck connected to said drill head including an upper end having a driving configuration, said driving configuration being one of a male or female end;

a drill bit having a lower shank portion; and at least two identical drill steel drivers each having a lower end and an upper end having complementary driving configurations including one male and one female end, and wherein the lower end of each drill steel driver is capable of engagement with either the complementary upper end of said chuck or the complementary upper end of another drill steel driver, and wherein the upper end of each said drill steel driver is capable of engagement with either the lower shank portion of said drill bit or the complementary lower end of another drill steel driver, and whereby in a drilling operation initially one said drill steel driver is interconnected between said drill bit and said chuck, after which, in order to continue said drilling operation another of said drill steel drivers may be interposed between said chuck and the lower end of said one drill steel driver thereby drilling the hole to the desired depth.

9. An apparatus for drilling bolt holes as recited in claim 8 wherein the upper end of said chuck, and the upper and lower ends of said drill steel drivers are generally hexagonal in configuration.

10. An apparatus for drilling bolt holes as recited in claim 8 wherein said chuck further includes an axial bore for the collection of particles.

11. An apparatus for drilling bolt holes as recited in claim 8 wherein said drill steel drivers are hollow, such that they may be used in conjunction with a vacuum system.

12. A method of drilling a bolt hole in a mine roof utilizing a roof bolting drill provided with a chuck having an upper end defined by a driving configuration, said driving configuration being one of a male or female end, a drill bit having a lower shank portion, and at least two identical drill steel drivers, said drill steel drivers having an upper end and a lower end, having complementary configurations including one male and one female end, wherein the upper end of the drill steel driver is capable of engagement with either the lower shank portion of the drill bit or the complementary lower end of another drill steel driver, and wherein the lower end of each drill steel driver is capable of engagement with either the complementary upper end of said chuck or the complementary upper end of another drill steel driver, said roof bolting drill being further provided with a drill head connected to said chuck, said drill head being movable in the vertical direction and capable of rotating said chuck, said method comprising the steps of:

(a) mounting the lower end of one of said drill steel drivers into the complementary upper end of said chuck;

(b) mounting the shank of the drill bit into the upper end of said one drill steel driver;

(c) raising said drill head until said drill bit abuts the mine roof;

(d) rotating said chuck while simultaneously raising said drill head such that said drill bit bores into said roof creating a bolt hole and continuing said rotating and raising until said one drill steel driver is at least partially disposed within said bolt hole;

(e) disconnecting said one drill steel driver from said chuck;

(f) lowering said drill head while said one drill steel driver and said drill bit is maintained in the hole;

(g) mounting the lower end of another drill steel driver into the complementary upper end of said chuck;

(h) raising said drill head until the upper end of said another drill steel driver abuts the complementary lower end of said one drill steel driver;

(i) connecting the upper end of said another drill steel driver to the complementary lower end of said one drill steel driver;

(j) rotating said chuck while simultaneously raising said drill head such that said drill bit bores further into said roof; and (k) lowering said drill head with said drill steel drivers and said drill bit connected thereto from said bolt hole while being rotated.

13. A method of drilling a bolt hole as recited in claim 12 wherein prior to said step (k) of lowering said drill head to remove said drill steel drivers from said hole, additional drill steel drivers are interposed in accordance with steps (g) through (j) until a bolt hole is drilled to the desired depth.

14. A method of drilling bolt holes as in claim 12 further including the step of attaching a sealing ring between said drill steel drivers thereby permitting the use of a liquid coolant to pass through the drill steel drivers.

* * * * *